United States Patent [19]

Lloyd et al.

[11] Patent Number: 4,570,043

[45] Date of Patent: Feb. 11, 1986

[54] DIELECTRIC FLUIDS AND APPARATUS INCORPORATING SUCH FLUIDS

[75] Inventors: Harold Lloyd, Christchurch; David S. L. Slinn, Bristol, both of United Kingdom

[73] Assignee: The Electricity Council, London, England

[21] Appl. No.: 499,701

[22] Filed: May 31, 1983

[30] Foreign Application Priority Data

Jul. 2, 1982 [GB] United Kingdom ..... 8219207

[51] Int. Cl.[4] ..... H01B 3/20; H01B 3/24; H01H 33/68

[52] U.S. Cl. ..... 200/150 A; 200/153 M; 252/570; 252/580; 252/581; 336/94; 570/134; 570/181

[58] Field of Search ..... 252/570, 580, 581; 336/94; 200/150 A, 153 M; 570/134, 181

[56] References Cited

U.S. PATENT DOCUMENTS

| | | | |
|---|---|---|---|
| 3,080,430 | 3/1963 | Cohen et al. | 252/570 |
| 3,285,858 | 11/1966 | Hirsh et al. | 252/172 |
| 3,630,926 | 12/1971 | Haase et al. | 252/DIG. 9 |
| 3,773,273 | 5/1973 | Munro et al. | 252/570 |
| 4,157,976 | 6/1979 | Ostrozynski et al. | 252/570 |
| 4,293,433 | 6/1981 | Borror et al. | 336/94 |
| 4,401,871 | 8/1983 | Lloyd et al. | 252/580 |

FOREIGN PATENT DOCUMENTS

| | | |
|---|---|---|
| 0037280 | 7/1981 | European Pat. Off. . |
| 1152930 | 5/1969 | United Kingdom . |
| 1492037 | 11/1977 | United Kingdom . |

*Primary Examiner*—John E. Kittle
*Assistant Examiner*—Mukund J. Shah
*Attorney, Agent, or Firm*—Beveridge, DeGrandi & Weilacher

[57] ABSTRACT

Dielectric, cooling or arc-extinguishing fluids comprise a mixture of tetrachlorodifluoroethane and perchloroethylene, optionally with incorporation of a third component which is preferably trichlorotrifluoroethane. Transformer and circuit-interrupter apparatus containing such dielectric fluids are also described.

25 Claims, 1 Drawing Figure

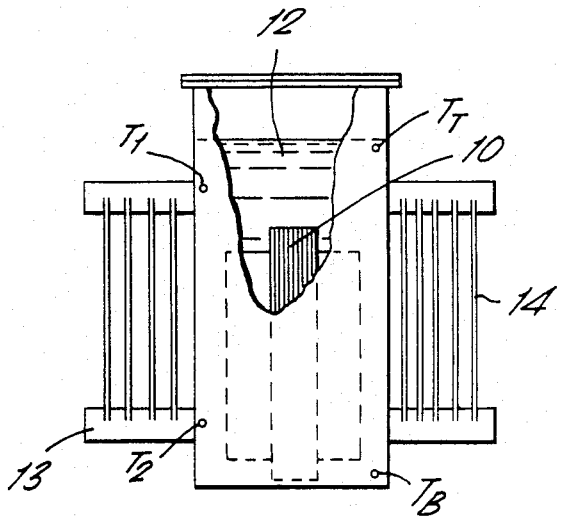
12
$T_T$
$T_1$
10
14
13
$T_2$
$T_B$

DIELECTRIC FLUIDS AND APPARATUS INCORPORATING SUCH FLUIDS

This invention relates to dielectric fluids and more particularly to dielectric and coolant media for transformers and to dielectric and arc-extinguishing media for use in electrical circuit interrupting devices such as switchgear and fusegear.

The term transformer as used herein will be understood to be a piece of static apparatus which by electromagnetic induction transforms alternating voltage and current between two or more windings at the same frequency and usually at different values of voltage and current; liquid-filled transformers are well-known and the liquid in the transformer normally constitutes both a dielectric and a coolant.

The term switchgear as used herein will be understood to include: circuit breakers, ring main units, switches, switch fuses, switch disconnectors and the like for switching or breaking electrical circuits.

Switchgear normally includes a plurality of movable circuit interrupting contacts which may be connected to or disconnected from corresponding fixed contacts, all of which are disposed in a reservoir or chamber containing or surrounded by a dielectric fluid medium. If the contacts are immersed or enveloped in the dielectric fluid, as the contacts separate during normal operation a transient arc is briefly established in the medium, such arcing normally being rapidly suppressed by the medium. The present invention also includes switchgear in which the contacts for making and breaking normal and abnormal currents are contained within a vacuum chamber surrounded by a dielectric and coolant fluid.

The term fuse is a generic term for a device that by the melting of one or more of its specially designed and proportioned components, opens the circuit in which it is inserted and interrupts the current when it exceeds the given value for a sufficient time. More particularly it includes liquid-filled fuses in which the fuse-element is enclosed in an insulating container filled to an appropriate level with an arc-extinguishing fluid. The equipment in which it is fitted is termed the fuse-gear and can include a switching device in conjunction with fuses.

The term Askarels is a generic term for fire resistant insulating fluids and are composed of polychlorinated biphenyls (PCB's) with or without the additions of polychlorinated benzenes as defined in International Electrotechnical Commission (IEC Standard) Publication 588 -1: 1977. 'Askarels for transformers and capacitors'. PCB's are non-biodegradeable and an environmental hazard. Silicones, complex esters and paraffinic oils are used in transformers as direct replacements for PCB's. However, these produce large fireballs under the conditions described.

Recently two USA companies have introduced specially designed transformers, one using perchloroethylene and another containing 113 trichlorotrifluoroethane as the dielectric and coolant fluid. Trichlorotrifluoroethane is highly volatile so that under catastrophic failure conditions it results in a vapour concentration in air such that personnel within the vicinity of the failure would be rendered insensible. Under normal operating conditions very high vapour pressures are produced by the trichlorotrifluoroethane within a sealed transformer (or switchgear) which requires a substantial pressure vessel to contain the fluid; the vessel is both expensive and impractical; special cooling arrangements for the fluid/vapour have been provided but again are expensive.

Perchloroethylene has been known as a dielectric fluid for many years. Its pour point is about −19° C. which is generally considered to be unsuitable for switchgear and transformer application and is outside the values specified in national and international standards for such apparatus. Also perchloroethylene produces unacceptable concentrations of carbonyl chloride, chlorine and perchloroethylene vapour under catastrophic conditions. To reduce the pour point of perchloroethylene, the addition of trichlorobenzene has been proposed. Full-scale catastrophic failure tests clearly show this blend to be flammable.

The use of perchloroethylene as a dielectric and coolant fluid for transformers has been advocated in the USA in the EPRI Journal (July/August 1979) and there is particular reference to it admixed with hydrocarbon electrical insulating oil, which is claimed to be non-flammable. Full-scale catastrophic failure tests, however clearly show a considerable fireball.

We have found that under conditions of catastrophic failure, as described hereafter, compositions having more than about 1% by weight of hydrogen will flame in admixture with perchloroethylene, and produce explosive gases.

Furthermore transformers and switchgear under normal operating conditions can suffer from electrical discharges. These discharges can break down the molecules of the fluid contained in the device. If the molecule contains chlorine and hydrogen, such as blends of perchloroethylene with trichlorobenzene, or hydrocarbon insulating oil, or an ester, then hydrogen chloride (HCl) will be formed. Hot spot temperatures in the windings of transformers can also give rise to the formation of HCl. Acid acceptors can be introduced into these fluids. However eventually these acceptors will become spent and accept no further HCl. This HCl is highly corrosive and causes significant damage to the construction materials of the transformers. This highly corrosive condition has been found in transformers which have been filled with blends of polychlorinated biphenyl as the dielectric and coolant fluid.

Hydrocarbon insulating oil similar to that defined in British Standard 148: 1972 has been, and is still used extensively as a dielectric and coolant medium for transformers and as a dielectric and arc-extinguishing medium for switchgear. Faults may occur in the contact moving mechanism of switchgear and short circuits may occur as a result of equipment or insulation failure in switchgear and transformers. Such failures may result in the occurrence of intense and prolonged arcing through the oil resulting in an explosive generation of hydrocarbon vapours. In one type of device the chamber is pressure sealed and in another the top of the chamber is closed by a lid so as to operate at ambient pressure. In neither case can the blast of hydrocarbon vapours be contained; chamber rupture occurs and is accompanied by the ignition or sometimes detonation of the hydrocarbon vapour by the arc in the presence of air, usually resulting in a fireball.

The standard methods for determining flammable characteristics include open and closed cup and explosion chamber tests; these are not applicable and do not reflect the conditions of catastrophic failure of transformers or switchgear. Thus the units including fluid must be tested as a whole. Under high-energy arcs, which occur during catastrophic failure conditions the temperatures (about 15,000° C.) are considerably higher than those in laboratory cup-tests, giving rise to different free radical formation and a faster evolution of flammable gases. Hydrogen and ethylene are both produced in copious quantities from hydrogen-containing materials and these gases require very high proportions of halocarbons to prevent explosion in the vapour phase.

Relatively high energy internal arcing tests typically at 3-phase 12 kV; 13.1 kA for a duration up to 1 second, have been carried out in switchgear and transformers to simulate an internal breakdown of insulation and a short-circuit resulting in catastrophic failure. This test method was carried out on a considerable number of fluids and blends of compounds and clearly shows that fluids based on hydrogen-containing molecules, having a relatively high fire-point of (say) 350° C., compared to BS 148 hydrocarbon oil (circa 140° C.) shows no appreciable improvement under full scale catastrophic failure conditions since all produce explosive and flammable gases which ignite, leading to a considerable fireball. Table 1 lists some of the fluids which have been subjected to full-scale catastrophic failures tests, noting those which flamed and those which did not.

Table 1 also gives the temperatures and their duration within the vicinity of the switchgear or transformer for prior art dielectric fluids under catastrophic failure conditions. For fluids exhibiting no fireball or flame, temperature profiles of the gaseous cloud were taken as it was ejected from the equipment. In general, temperature measurements by infra-red showed values less than 300° C. for less than 0.5 seconds, in the absence of a flame. Surface temperatures at 500 mm from the equipment under test as measured by temperature strips were generally less than 50° C. for 1 second. Humans can tolerate air temperatures of 500° C. for about 2 seconds, and 200° C. for about 2 minutes. These results show that, in the absence of a flame, exposure to high temperatures is not a problem.

It has been proposed to use fluids incorporating hydrogen-containing molecules for these purposes, but it has been found that even small proportions of hydrogen atoms in the molecules can lead to the formation of acid products under arcing conditions. It is therefore desirable to use non-hydrogen-containing compounds for these uses. Unsaturated carbocyclic halocarbons containing hydrogen cause problems also, as they tend to degrade appreciably to produce carbon and acid. Also these materials have significantly lower values of electrical volume resistivity and dissipation factor, than fully-halogenated compounds.

It has been proposed to use non-flammable dielectric media, and many fluids have been suggested for this purpose.

Examples are to be found in British patent specifications Nos. 1,492,037 and 1,152,930.

In a first aspect this invention consists in a dielectric, cooling or arc-extinguishing fluid comprising a blend of tetrachloro-difluoroethane with perchloroethylene.

Preferably the proportion of the tetrachlorodifluoroethane is between 10 and 50% by weight of the mixture; more preferably 20%–40%.

Tetrachloro-difluoroethane, available as a commercial material, is normally a mixture of symmetrical and asymmetrical isomers. It has a boiling point of about 93° C. and a freezing point between 26° and 42° C. depending upon the isomer ratio.

Preferably, the fluid may incorporate as a third component other aliphatic or carbocyclic fluorine-containing halocarbons which are hydrogen-free and generally of a lower boiling point than the two principal components, in order to aid cooling by evaporation, to significantly reduce toxic products and to enhance the electron-capture capacity of the fluid. Particularly preferred compounds are those which are capable of forming electron-capturing free radicals, e.g. $CF_3$, $CF_2Cl$, $CFCl_2$, etc. This cooling by evaporation can be particularly advantageous where it significantly reduces the hot spot and gradient temperatures in transformer windings. Preferred examples of third components according to the invention are perfluoro (n-pentane)
perfluoro (n-hexane)
perfluoro (cyclopentane)
perfluoro (cyclohexane)
tetrafluorodibromoethane
monofluorotrichloromethane
trichlorotrifluoroethane and
dichlorotetrafluoroethane which may be present in amounts up to 25% by weight of the mixture; more preferably up to 10% by weight.

In general, fluid mixtures according to the invention will normally be in the liquid phase under working conditions (the boiling point being generally above 100° C.), although in switchgear some evaporation and a small amount of degradation may occur due to the heat produced when electrical contacts are opened and arcing occurs. However, amounts of carbon produced are small and the dielectric behaves as an effective arc-extinguishing fluid with a minimum of decomposition.

The fluids according to this invention are completely non-flammable under conditions of catastrophic failure.

The fluids according to the invention are particularly effective as arc-suppressing or extinguishing agents. Such fluids are also effective in suppressing or extinguishing corona discharge in the media or in the vapour space above the media because of their capacity to absorb free electronic charge carriers responsible for the discharge.

The fluids according to this invention exhibit electrical properties at least as good as those values given in British Standard: 148; 1972 and in other equivalent national or international specifications such as IEC 296: 1969 of the International Electro-Technology Commission. Table 2 gives values of the dielectric strength (kV) and volume resistivity (ohm centimeters) for three blends of fluids according to the invention by way of example only and includes, for comparison purposes, corresponding data on other fluids.

These blends have proved themselves to exhibit good dielectric properties and due to their high density and low viscosity are excellent coolants for use in transformers. The blending of these fluids in the preferred proportions allows a lowering of the melting point where the melting point of the unsaturated perchloroethylene is too high for use alone as a fluid in transformer apparatus. Pour points of three blends are given in Table 2, by way of example.

Any candidate material must fulfil certain minimum physical and electrical criteria if it is to be used as a dielectric fluid. Essential properties include high electrical breakdown strength, high volume resistivity, low pour point, high boiling point and chemically compatibility with other materials which are used to construct the apparatus. Tests at 100° C. and in the presence of copper have shown the fluids of the invention to be thermally stable.

In a second aspect this invention consists in liquid-filled transformer apparatus which contains as the essential dielectric fluid a liquid mixture including tetrachlorodifluoroethane and perchloroethylene.

Preferably the tetrachlorodifluoroethane component comprises between 20% and 50% by weight of the liquid blend.

Preferably the dielectric fluid contains a third component which is a fluorinated aliphatic or carbocyclic halocarbon which is hydrogen-free and of a lower boiling point than the two principal components. Preferred third components for use in this context include perfluoro (n-pentane)
perfluoro (n-hexane)
perfluoro (cyclopentane)
perfluoro (cyclohexane)
tetrafluorodibromoethane
monofluorotrichloromethane and
trichlorotrifluoroethane This third component can be present in amounts up to 25% by weight, more preferably up to 10% by weight of the overall mixture. It is believed that this third component contributes to the efficiency of the dielectric fluid by taking up heat from hot-spots in the transformer windings by vapourization. Furthermore, under failure conditions of the test equipment, this third component evaporates preferentially into the arc region and substantially reduces the concentration of perchloroethylene vapour, measured at the point of test-equipment rupture. Tests results and emergency exposure limits in tests on a transformer are given in Table 5. The perchloroethylene vapour is replaced by less toxic chlorofluorocarbon products, such as $CCl_3F$, $CCl_2F_2$ and $CClF_3$ and $CF_4$.

Thus, for example, the presence of trichlorotrifluoroethane in the dielectric fluid (in amounts up to about 10% by weight) promotes the formation of vapour bubbles and incipient boiling, taking up heat from the vicinity of hot-spots in the transformer windings.

A fluid according to this invention has been temperature-rise tested in a typical transformer as shown in the accompanying FIGURE which is a diagram showing some of the locations at which temperature measurements were made. For comparative purposes other fluids which are sold as dielectric and coolant media were also tested under identical conditions in the same transformer.

In the FIGURE, two windings 10 are shown immersed in a dielectric and coolant fluid 12. This transformer was of the sealed type with panel radiators 13, 14 and, for test purposes, was fitted with 48 thermocouples of which 32 were on the high and low voltage windings. $T_1$ and $T_2$ are typical of such thermocouples but particular reference will be made to $T_T$ and $T_B$ respectively at the top and at the bottom of the fluid.

Table 3 shows the values of certain temperature measured:

$T_T$=Top fluid temperature (°C.)
$T_{AVE}$=Average fluid temperature (°C.)
$T_{HOTSPOT}$=Temperature of hottest part of the winding The rating of the transformer was 11000/433 volts 3-phase 500 kVA having total 'copper' and 'iron' losses of 8050 watts and having 18 cooling panels.

The test results of Table 3 show that a fluid according to this invention gave lowest increase of top fluid temperature and showed the lowest hot-spot and temperature rise compared with the other fluids tested.

The temperature difference $T_T-T_{AVE}$ clearly shows that the fluid of this invention flows significantly faster than do the comparative fluids. A significant correlation exists between the viscosity of each fluid and its heat transfer properties which are reflected in the temperatures obtained in the test results. In particular, the hot-spot temperature for the transformer with the fluid of this invention is about 25% less than that for BS.148 insulating oil and about a 45% improvement over paraffinic oils.

This test evidence shows that considerable economies can be achieved by utilising the very significant heat transfer properties of the fluid according to this invention in otherwise conventional transformers.

In order to further illustrate the superior heat-transfer properties of fluids according to this invention the following data is submitted showing the winding temperature gradients in the test transformer shown in the FIGURE with various different dielectric fluids; perchloroethylene (P), perchloroethylene+tetrachlorodifluoroethane (112), perchloroethylene+trichlorotrifluoroethane (113), and perchloroethylene+tetrachlorodifluoroethane and trichlorotrifluoroethane.

| FLUID COMPOSITION (wt %) | WINDING TEMPERATURE GRADIENTS (°C.) Low Voltage | High Voltage | TRANSFORMER DETAILS |
|---|---|---|---|
| (a) P | 6.7 | 9.1 | 8050 W 11000/433 V 500 kVA 3 phase 18 Radiator Panels designed to BS.171: 1978. |
| (b) P + 112(70:30) | 5.3 | 6.0 | |
| (c) P + 113(91:9) | 3.6 | 5.0 | |
| (d) P + 112 + 113 (66.7:28.6:4.7) | 3.5 | 5.0 | |

The "winding temperature gradient" is a well-known parameter used in considering the cooling of transformers and essentially is a measure of the difference in temperature between the mass of fluid and the mass of the coils. It can be seen from the results above that (i) the use, see (b), of the 2-component fluid blend, according to the invention, shows an improvement of between 30% and 50% in cooling capability compared with the use of perchloroethylene alone, and (ii) the addition of 9% w/w of trichlorotrifluoroethane to perchloroethylene or 5% w/w to the two-component blend, see (d), gives a further 20% improvement in heat-removal capability—however the use of perchloroethylene+113 is unsuitable because of pour point/pressure considerations. Also the volatility of 113 presents a toxicity hazard at the higher 113 concentration.

In order to illustrate the non-flammability and the low toxicity of transformer fluids according to this invention, under catastrophic failure conditions, the following test procedure was carried out.

A 500 kVA 11000/433 volts three-phase typical distribution transformer was subjected to a catastrophic failure test by arranging an internal short circuit and applying fault energy of 12 kV; 13 kA for a duration of 300 ms. The transformer contained 585 liters of the blend: (66% perchloroethylene with 28.3% tetrachlorodifluoroethane with the addition of 5.7% by weight of 1,1,2-trichlorotrifluoroethane) in a confined space. Under these test conditions a small quantity of vapour and liquid emerged from the pressure relief valve. There was no flame or explosive gases produced at all. By infra-red measurement the emerging vapour/fluid did not exceed a temperature of 175° C., for a duration of less than 200 ms.

Samples of the small gas cloud around the transformer in the closed space during the destructive tests were taken at intervals of: instantaneous, 10 s. and 1 min. Analyses were carried out on the samples which included infra-red, bubbler and "Draeger" tube techniques. The concentrations, in vpm, of the halocarbons and gases produced were identified and are given in Table 4.

7 sampling devices (at head height) were used:
3 instantaneous
2 at 10 seconds later
2 at 1 minute later.

Table 4 lists the concentrations of chemical species identified in the gas/vapour cloud around the transformer following catastrophic failure, using as transformer fluid 66%/28.3% perchloroethylene/tetrachlorodifluoroethane with the addition of 5.7% (wt. of mixture) of trichlorotrifluoroethane.

Under the test conditions described above none of the concentrations of the chemical species detected represents a serious toxic hazard.

Under comparable test conditions with the transformer unit filled with perchloroethylene alone, the concentration of perchloroethylene at catastrophic failure is typically 3,000 ppm over 2 minutes and instantaneous 6,000 ppm.

In a third aspect, this invention consists in sealed switchgear incorporating circuit-interrupter apparatus having at least two electrical contacts and means for closing and separating said contacts, the contacts being separated in the presence of an arc-extinguishing fluid comprising a blend of perchloroethylene and tetrachlorodifluoroethane.

Switching tests using hermetically sealed units filled with fluid blends, according to this invention, have shown negligible pressure rises following 30 switching operations at 12 kV, 500 amperes and a power factor of 0.7. With BS148 hydrocarbon insulating oil in place of the said fluid and under the same switching conditions considerable pressure was built up after only a few switching operations, causing rupture of the switching device tank. Sealed switchgear having, for example, a nitrogen-filled headspace has the advantage of a predetermined environment, whereas unsealed switchgear can suffer from the ingress of such undesirable extraneous impurities as moisture or oxygen.

Preferably the fluid contains between 10% and 30% (by weight) of the tetrachlorodifluoroethane component.

Typical tests show that perchloroethylene alone has a very unsatisfactory switching performance and is unable to properly extinguish arcs during repeated electrical switching interruptions.

It is understood that this is due, in part, to the decomposition products formed during arcing and also to the breakdown of the perchloroethylene molecule, forming chlorine in substantial amounts. The addition of fluorine-atom-containing molecules in the mixture provides improvement in the arc-extinguishing performance of the fluid. It is believed that the reason for this enhanced performance is the presence of electron-capturing free radicals such as $CF_3$, $CF_2Cl$ etc. Thus, the presence of trichlorotrifluoroethane in the fluid mixture promotes the formation (under arcing conditions) of species such as $CF_4$, $CClF_3$, and $CCl_2F_2$, which have excellent dielectric properties, low toxicity and assist arc-extinction, compared with the two-component fluid, due to reduction of the concentration of perchloroethylene in the region of the arc. The presence of electron capturing free radicals such as $—CF_3$, $—CF_2Cl$, etc., also appears to enhance the electron-capture properties of the arc-extinguishing fluid.

TABLE 1

FLAMMABILITY AND TEMPERATURE MEASUREMENTS ON FLUIDS TESTED AT CATASTROPHIC FAILURE

| FLUID | FLAMED | TEMPERATURE + DURATION OF VAPOUR OR FLAME | OBSERVATIONS |
|---|---|---|---|
| Perc + BS148 (Ins. Oil) | Yes | >1000° C./5s | Flammable - Acid gases |
| BS 148 - Oil | Yes | >1000° C./10s | Flammable |
| Trichloro-Benzene | Yes | >700° C./1s | and acid gases |
| Perchloro-Ethylene | No | 500° C./0.8s | Poor discharge and arcing, unacceptable pour point |
| Silicone oil | Yes | >1000° C./5s | Flammable, high viscosity |
| BS148/ 113 (50/50%) | No | 600° C./1s | High vapour pressure; considerable acids |
| Complex esters | Yes | >1000° C./7s | Flammable |
| Phosphate Ester | Yes | >1000° C./5s | Flammable |
| D.C.B.T.F. | Yes | 700° C./0.7s | Flammable |

TABLE 1-continued

FLAMMABILITY AND TEMPERATURE MEASUREMENTS ON FLUIDS TESTED AT CATASTROPHIC FAILURE

| FLUID | FLAMED | TEMPERATURE + DURATION OF VAPOUR OR FLAME | OBSERVATIONS |
|---|---|---|---|
| | | | and acid gases |

NOTES
D.C.B.T.F. = Dichlorobenzotrifluoride
Perc. = Perchloroethylene
113 = Trichlorotrifluorotrifluoroethane
Catastrophic failure conditions: prospective fault energy 3 phase 12 kV, 13 kA for up to 500 ms. Test equipment contained 60 liters of fluid.

TABLE 2

Some comparative electrical and physical properties of dielectric fluids

| % Tetrachloro-difluoroethane in Perchloro-ethylene | Pour Point °C. | Boiling Point °C. | Electrical Breakdown strength (kV)* | Volume Resistivity (ohm cms)* | Dielectric Constant* | Diss Factor* Tan δ |
|---|---|---|---|---|---|---|
| 20 | −26 | 113 | >60 | $4 \times 10^{13}$ | 2.5 | .004 |
| 30 | −32 | 111 | >60 | $4 \times 10^{13}$ | 2.5 | .004 |
| 50 | −42 | 105 | >60 | $4 \times 10^{13}$ | 2.5 | .004 |
| 23° C. | | 111 | >60 | $1 \times 10^{13}$ | 2.35 | .007 |
| 30 | | 111 | >60 | $1 \times 10^{12}$ | 2.53 | .05 |
| 100° C. | | | | | | |
| Perchloroethylene | | 121 | >60 | $1 \times 10^{13}$ | 2.4 | .008 |
| 113 | | 47 | >60 | $1 \times 10^{13}$ | 2.5 | .005 |
| 23° C. | | | >60 | $1 \times 10^{14}$ | 2.24 | .0013 |
| BS. 148 | | | >60 | $1 \times 10^{12}$ | 2.18 | .06 |
| 100° C. | | | | | | |
| Insulation Oil | | | | | | |

*Electrical tests carried out at 20° C. unless otherwise stated.
Pour Point reduces by about 3° C. when 5% of 11 or 113 is added to 2-component mixtures, the electrical properties remaining substantially the same.
113 = Trichlorotrifluoroethane
11 = Trichloromonofluoromethane

TABLE 3

TEMPERATURE RISE TESTS RESULTS FOR VARIOUS DIELECTRIC AND COOLANT FLUIDS (IN °C.)
In a 500 kVA, 3-phase, 11000/433 volt sealed transformer.
Designed to BS 171: 1978, having total losses of 8050 watts.

| FLUID Composition (by wt) | MEASURED THERMOCOUPLES VALUES $T_T$ | $T_{AVE}$ | $T_T$-$T_{AV}$ | $T_{HOT\ SPOT}$ | OBTAINED FROM DATA TYPICAL VISCOSITY at 50° C. CENTIPOISE |
|---|---|---|---|---|---|
| P:112:113 66.7:28.6:4.7 | 40.7 | 37.2 | 3.5 | 66.4 | 0.71 |
| BS.148 Insulating Oil | 48.0 | 40.1 | 7.9 | 86.0 | 12.0 |
| Complex Ester | 48.5 | 39.2 | 9.3 | 88.6 | 38.0 |
| Silicone | 48.5 | 38.0 | 10.5 | 93.4 | 43.0 |
| Paraffinic Oil | 54.7 | 40.5 | 14.5 | 101.2 | 85.0 |

NB: All test conditions remained the same for each fluid

TABLE 4

CONCENTRATIONS OF CHEMICAL SPECIES IDENTIFIED IN THE GAS/VAPOUR CLOUD AROUND THE TRANSFORMER FOLLOWING CATASTROPHIC FAILURE CONDITIONS

| CHEMICAL COMPOUND | CONCENTRATIONS IN VPM AFTER INST | 10s | 1 Min |
|---|---|---|---|
| Perchloroethylene | 1100 | 1200 | 270 |
| 112 | 130 | 120 | 65 |
| 113 | 80 | 20 | 20 |
| Carbontetrafluoride (14) | 5 | 5 | 5 |

TABLE 4-continued

CONCENTRATIONS OF CHEMICAL SPECIES IDENTIFIED IN THE GAS/VAPOUR CLOUD AROUND THE TRANSFORMER FOLLOWING CATASTROPHIC FAILURE CONDITIONS

| CHEMICAL COMPOUND | CONCENTRATIONS IN VPM AFTER INST | 10s | 1 Min |
|---|---|---|---|
| 11 | 60 | 80 | 35 |
| 13 | 20 | 20 | 20 |
| Chlorine* | 2 | ND | 3 |
| Hydrogen chloride | 2.5 | ND | ND |

TABLE 4-continued

CONCENTRATIONS OF CHEMICAL SPECIES IDENTIFIED IN THE GAS/VAPOUR CLOUD AROUND THE TRANSFORMER FOLLOWING CATASTROPHIC FAILURE CONDITIONS

| CHEMICAL COMPOUND | CONCENTRATIONS IN VPM AFTER | | |
|---|---|---|---|
| | INST | 10s | 1 Min |
| Carbonyl chloride* | ND | ND | ND |
| Carbon monoxide | ND | ND | ND |
| Carbonylfluoro chloride | ND | ND | ND |

ND = non detected below 1 vpm
11 = trichloromonfluoromethane
13 = monochlorotrifluoromethane
*not detected; below 0.5 vpm.

TABLE 5

CATASTROPHIC FAILURE TESTS

| Liquid | Time of Sampling (min.) | Concentration (ppm w/v) of halocarbons at point of rupture of test equipment (60 l capacity) during catastrophic failure test. Prospective energy 3 Ph, 12 KV, 13 KA for 500 ms. | | | |
|---|---|---|---|---|---|
| | | P | 112 | 113 | 11, 12, 13, 14 total* |
| P | 0 | 6000 | — | — | — |
| Average of | 1 | 4000 | — | — | — |
| 3 tests | 5 | 3500 | — | — | — |
| P/112 70/30 | 0 | 1500 | 930 | — | 1400 |
| w/w Average | 1 | 800 | 200 | — | 350 |
| of 5 tests | | | | | |
| P/112/113 | 0 | 1300 | 480 | 90 | 850 |
| 66.7:28.6:4.7 | •1 | 500 | 50 | <10 | 90 |
| w/w Average | | | | | |
| of 4 tests | | | | | |
| Emergency exposure limit | for 5 min exposure time | 1500 | 1500 | 4000 | 3000 |

Notation
P = Perchloroethylene
112 = Tetrachlorodifluoroethane (90:10 symm:assymm isomers w/w)
113 = 1,1,2 trichloro-1,2,2,-trifluoroethane
Trichloromonofluoromethane
Dichlorodifluoromethane
Monochlorodifluoromethane
Tetrafluoromethane
*11 content was about one half of total

We claim:

1. A dielectric, cooling or arc-extinguishing fluid comprising
(a) at least 75% by weight of a blend of tetrachlorodifluoroethane with perchloroethylene, and
(b) up to 25% by weight of a hydrogen-free fluorine-containing aliphatic or carboxylic halocarbon;
wherein the tetrachlorodifluoroethane comprises from 10% to 50% by weight of said blend of tetrachlorodifluoroethane with perchloroethylene.

2. A fluid as claimed in claim 1 wherein the proportion of tetrachlorodifluoroethane is from 20% to 40% by weight.

3. A fluid as claimed in claim 1 wherein said hydrogen-free fluorine-containing aliphatic or carbocyclic halocarbon is selected from the group consisting of
perfluoro (n-pentane)
perfluoro (n-hexane)
perfluoro (cyclopentane)
perfluoro (cyclohexane)
tetrafluorodibromoethane
monofluorotrichloromethane and
trichlorotrifluoroethane.

4. A fluid as claimed in claim 1 wherein said hydrogen-free fluorine-containing aliphatic or carbocyclic halocarbon is trichlorotrifluoroethane.

5. A fluid as claimed in claim 1 wherein said hydrogen-free fluorine-containing aliphatic or carbocyclic halocarbon is present in an amount of up to 10% by weight.

6. A fluid as claimed in claim 1 wherein said hydrogen-free fluorine-containing aliphatic or carbocyclic halocarbon is present in an amount of from 5 to 10% of the weight of the fluid.

7. Transformer apparatus containing a dielectric cooling fluid around windings wherein the fluid comprises a fluid blend of
(a) at least 75% by weight of a blend of tetrachlorodifluoroethane with perchloroethylene, and
(b) up to 25% by weight of a hydrogen-free fluorine-containing aliphatic or carbocyclic halocarbon.

8. Transformer apparatus as claimed in claim 7 wherein said hydrogen-free fluorine-containing aliphatic or carbocyclic halocarbon is selected from the group consisting of
perfluoro (n-pentane)
perfluoro (n-hexane)
perfluoro (cyclopentane)
perfluoro (cyclohexane)
tetrafluorodibromoethane
monofluorotrichloromethane and
trichlorotrifluoroethane.

9. Transformer apparatus as claimed in claim 7 in which the hydrogen-free halocarbon is trichlorotrifluoroethane.

10. Transformer apparatus as claimed in claim 9 wherein the trichlorotrifluoroethane is present in an amount of up to 10% by weight of the fluid.

11. Transformer apparatus as claimed in any one of claims 7, or 10 wherein the tetrachlorodifluoroethane content of the blend is from 20% to 40% by weight.

12. In sealed switchgear incorporating electrical circuit-interrupter apparatus having at least two electrical contacts and means for closing and separating said contacts and dielectric fluid surrounding said contacts, the use as said fluid of a fluid blend comprising
(a) at least 75% by weight of a blend of tetrachlorodifluoroethane with perchloroethylene, and
(b) up to 25% by weight of a hydrogen-free fluorine-containing aliphatic or carbocyclic halocarbon.

13. Switchgear as claimed in claim 12 wherein said hydrogen-free fluorine-containing aliphatic or carbocyclic halocarbon is selected from the group consisting of
perfluoro (n-pentane)
perfluoro (n-hexane)
perfluoro (cyclopentane)
perfluoro (cyclohexane)
tetrafluorodibromoethane
monofluorotrichloromethane and
trichlorotrifluoroethane.

14. Switchgear as claimed in claim 12 wherein the contacts are in vacuum chambers surrounded by said dielectric fluid.

15. Switchgear as claimed in claim 12 wherein the fluid contains between 20 and 40% by weight of tetrachlorodifluoroethane.

16. Switchgear as claimed in claim 12 wherein the third component is selected from the group comprising
perfluoro (n-pentane)
perfluoro (n-hexane)
perfluoro (cyclopentane)

perfluoro (cyclohexane)
tetrafluorodibromoethane
monofluorotrichloromethane and
trichlorotrifluoroethane.

17. Switchgear as claimed in claim 12 wherein the fluid contains 5 to 10% by weight of trichlorotrifluoroethane constituting said hydrogen-free fluorine-containing halocarbon.

18. A dielectric, cooling or arc-extinguishing fluid consisting of from 20% to 50% by weight of tetrachlorodifluoroethane and the balance perchloroethylene.

19. Transformer apparatus containing a coolant fluid comprising, by weight, substantially 66.7% perchloroethylene, 28.6% tetrachlorodifluoroethane and 4.7% trichlorotrifluoroethane.

20. Transformer apparatus containing a coolant fluid comprising, by weight, 70% perchloroethylene and 30% trichlorotrifluoroethane.

21. A fuse having a fuse element in an arc-extinguishing liquid within an insulating container wherein the liquid is a fluid blend of (a) at least 75% by weight of a blend of tetrachlorodifluoroethane with perchloroethylene, and (b) up to 25% by weight of a hydrogen-free fluorine-containing aliphatic or carbocyclic halocarbon.

22. A fuse as claimed in claim 21 wherein the liquid contains 20 to 50% by weight of tetrachlorodifluoroethane.

23. A fuse as claimed in claim 21 wherein said hydrogen-free fluorine-containing halocarbon is trichlorotrifluoroethane.

24. A dielectric fluid consisting of (a) at least 75% by weight of a liquid blend of tetrachlorodifluoroethane with perchloroethylene, the tetrachlorodifluoroethane being between 10% and 50% by weight of said liquid blend, and (b) up to 25% by weight of a hydrogen-free fluorine-containing halocarbon selected from the group consisting of perfluoro (n-pentane)
perfluoro (n-hexane)
perfluoro (cyclopentane)
perfluoro (cyclohexane)
tetrafluorodibromoethane
monofluorotrichloromethane and
trichlorotrifluoroethane.

25. A dielectric fluid as claimed in claim 24 wherein the tetrachlorodifluoroethane is between 20% and 40% by weight of said liquid blend.

* * * * *